US011289017B2

(12) United States Patent
Liu

(10) Patent No.: US 11,289,017 B2
(45) Date of Patent: Mar. 29, 2022

(54) PIXEL CIRCUIT AND RELATED DRIVING METHOD, AND DISPLAY PANEL

(71) Applicant: Shenzhen China Star Optoelectronics Semiconductor Display Technology Co., Ltd., Shenzhen (CN)

(72) Inventor: Shiqi Liu, Shenzhen (CN)

(73) Assignee: Shenzhen China Star Optoelectronics Semiconductor Display Technology Co., Ltd., Guangdong (CN)

( * ) Notice: Subject to any disclaimer, the term of this patent is extended or adjusted under 35 U.S.C. 154(b) by 184 days.

(21) Appl. No.: 16/640,759

(22) PCT Filed: Dec. 27, 2019

(86) PCT No.: PCT/CN2019/129027

§ 371 (c)(1),
(2) Date: Feb. 21, 2020

(87) PCT Pub. No.: WO2021/120290

PCT Pub. Date: Jun. 24, 2021

(65) Prior Publication Data

US 2021/0407405 A1 Dec. 30, 2021

(30) Foreign Application Priority Data

Dec. 16, 2019 (CN) ..... 201911290363.2

(51) Int. Cl.
*G09G 3/3233* (2016.01)

(52) U.S. Cl.
CPC ... *G09G 3/3233* (2013.01); *G09G 2300/0842* (2013.01); *G09G 2310/08* (2013.01)

(58) Field of Classification Search
None
See application file for complete search history.

(56) References Cited

U.S. PATENT DOCUMENTS

2020/0257447 A1 8/2020 Zhai et al.

FOREIGN PATENT DOCUMENTS

| | | | |
|---|---|---|---|
| CN | 203480803 | U | 3/2014 |
| CN | 107170408 | A | 9/2017 |
| CN | 107945741 | A | 4/2018 |
| CN | 109003574 | A | 12/2018 |
| CN | 110942749 | A | 3/2020 |

*Primary Examiner* — Aneeta Yodichkas
(74) *Attorney, Agent, or Firm* — Taft Stettinius & Hollister LLP

(57) ABSTRACT

A pixel circuit, a related driving method and a display panel are provided. The pixel circuit, which is a 7T1C type circuit includes a storage capacitor (Cst), a first transistor (T1), a second transistor (T2), a third transistor (T3), a fifth transistor (T5), and a first lighting element (R).

6 Claims, 2 Drawing Sheets

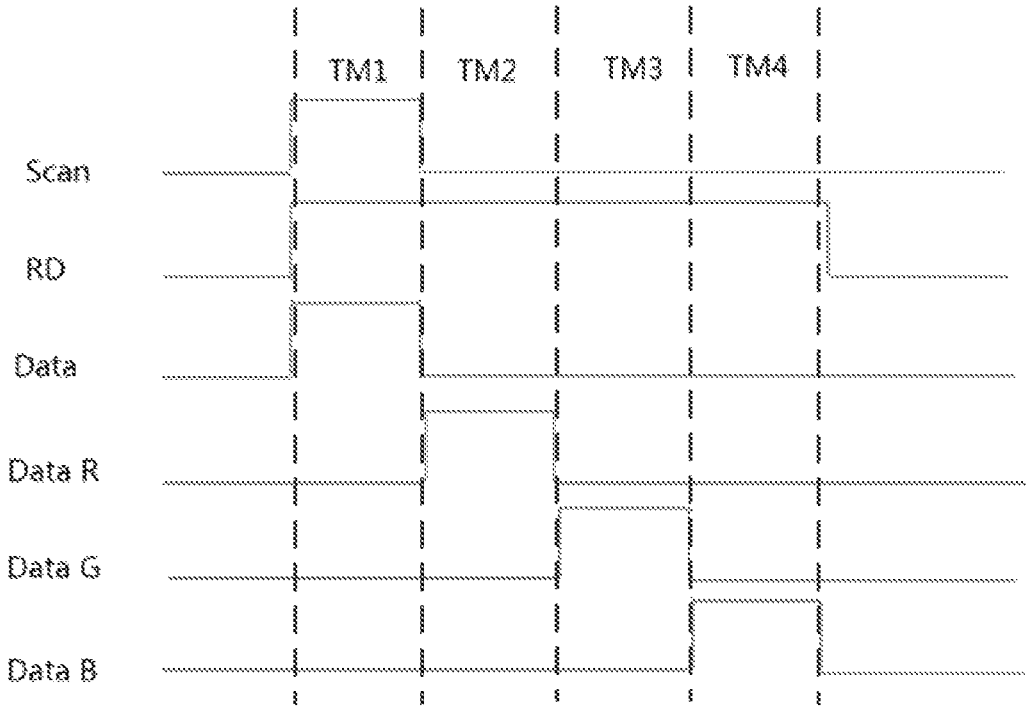
Fig. 2
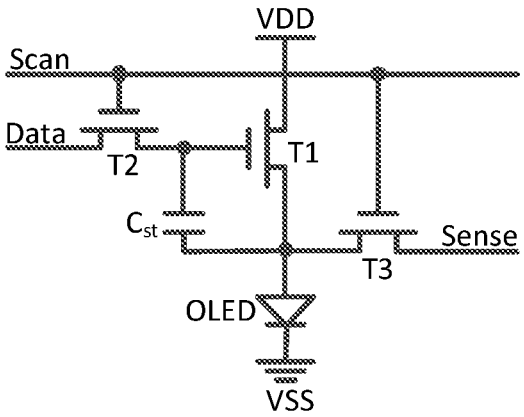
Fig. 3 (Related art)

PIXEL CIRCUIT AND RELATED DRIVING METHOD, AND DISPLAY PANEL

CROSS-REFERENCE TO RELATED APPLICATIONS

This application is a U.S. National Phase of International PCT Application No. PCT/CN2019/129027 filed Dec. 27, 2019, which claims the benefit of Chinese Patent Application Serial No. 201911290363.2 filed Dec. 16, 2019, the contents of each application are incorporated herein by reference in their entirety.

FIELD OF THE INVENTION

The present disclosure relates to a display technology, and more particularly, to a pixel circuit and related driving method and a display panel.

BACKGROUND OF THE INVENTION

As a development of display panel, large and high resolution panels, e.g. Active-matrix organic light emitting diode (AMOLED) panels, are more popular to the users.

The space for disposing pixel circuits is determined according to resolution of the panel. The higher the resolution is, the less the space for disposing pixel circuits is. It will cause the issue of circuit layout and processes in a limited space.

SUMMARY OF THE INVENTION

One objective of an embodiment of the present invention is to provide a pixel circuit, a related driving method and a display panel to solve the above-mentioned issue of circuit layout and processes in a limited space.

According to a first aspect of the present disclosure, a pixel circuit comprises:

a storage capacitor (Cst), comprising a first end and a second end; a first lighting element (R) comprising an anode and a cathode electrically connected to a reference voltage (Vss); a first transistor (T1), comprising a drain electrically connected to a supply voltage (Vdd), a source electrically connected to the second end of the storage capacitor (Cst), and a gate; a second transistor (T2), comprising a drain electrically connected to the first end of the storage capacitor (Cst), a source electrically connected to a data line (Data), and a gate electrically connected to a scan line (Scan); a third transistor (T3), comprising a drain electrically connected to a sensing line (Sense), a source electrically connected to the source of the first transistor (T1), and a gate electrically connected to the scan line (Scan); and a fifth transistor (T5), comprising a drain electrically connected to the anode of the first lighting element (R), a source electrically connected to the source of the first transistor (T1), and a gate electrically connected to a first lighting data line (Data R).

Furthermore, the pixel circuit further comprises: a fourth transistor (T4), comprising a source electrically connected to the sensing line (Sense), a drain electrically connected to a resetting line, and a gate electrically connected to a read line.

Furthermore, the pixel circuit further comprises: a second lighting element (G) having an anode and a cathode electrically connected to the reference voltage (Vss); and a sixth transistor (T6), comprising a source electrically connected to the source of the third transistor (T3), a drain electrically connected to the anode of the second lighting element (G), and a gate electrically connected to a second lighting data line (Data G).

Furthermore, the pixel circuit further comprises: a third lighting element (B), comprising an anode and a cathode coupled to the reference voltage (Vss); and a seventh transistor (T7), comprising a source electrically connected to the source of the third transistor (T3), a drain electrically connected to the anode of the third lighting element (B), and a gate electrically connected to a third lighting data line (Data B).

Furthermore, the fourth transistor (T4) is used to prevent current leakage from the sources of the fifth transistor (T5), sixth transistor (T6), and a seventh transistor (T7) to the sensing line (Sense).

Furthermore, the first transistor (T1) supplies constant driving current.

According to a second aspect of the present disclosure, a method of driving the above pixel circuit includes:

during a first time period that a high level voltage signal is inputted to the scan line (Scan), the data line (Data), the read signal line, and a low level voltage signal is inputted to the first lighting data line (Data R), the second lighting data line (Data G), and the third lighting data line (Data B), conducting the first transistor (T1), the second transistor (T2), the third transistor (T3), and fourth transistor (T4), and charging the storage capacitor (Cst);

during a second time period that the high level voltage signal is inputted to the read signal line and the first lighting data line (Data R), and the low level voltage signal is inputted to the scan line (Scan), the data line (Data), the second lighting data line (Data G), and the third lighting data line (Data B), conducting the fourth transistor (T4) and the fifth transistor (T5) to drive the first lighting element (R) to light, and obtaining a threshold voltage of the fifth transistor (T5);

during a third time period that the high level voltage signal is inputted to the read signal line and the second lighting data line (Data G), and the low level voltage signal is inputted to the scan line (Scan), the data line (Data), the first lighting data line (Data R), and the third lighting data line (Data B), conducting the fourth transistor (T4) and the sixth transistor (T6) to drive the second lighting element (G) to light, and obtaining a threshold voltage of the sixth transistor (T6); and during a fourth time period that the high level voltage signal is inputted to the read signal line and the third lighting data line (Data B), and the low level voltage signal is inputted to the scan line (Scan), the data line (Data), the first lighting data line (Data R), and the second lighting data line (Data G), conducting the fourth transistor (T4) and the seventh transistor (T7) to drive the third lighting element (B) to light, and obtaining a threshold voltage of the seventh transistor (T7).

Furthermore, a magnitude of current flowing through the first transistor (T1) is adjusted by controlling a charge of the storage capacitor (Cst).

Furthermore, during the first time period, using the sensing line (Sense) to monitor the first transistor (T1), the fifth transistor (T5), the sixth transistor (T6), and the seventh transistor (T7) by controlling on and off states of the third transistor (T3).

According to a third aspect of the present disclosure, a display panel comprises the pixel circuit as disclosed above.

The present invention provides a pixel circuit, a related driving method and a display panel. The present invention can reduce an occupied area of the pixel circuit, solving the above-mentioned issue relating to requiring processes to make complicated circuit layout in a limited space.

BRIEF DESCRIPTION OF THE DRAWINGS

To describe the technical solutions in the embodiments of this application more clearly, the following briefly introduces the accompanying drawings required for describing the embodiments. Apparently, the accompanying drawings in the following description show merely some embodiments of this application, and a person of ordinary skill in the art may still derive other drawings from these accompanying drawings without creative efforts.

FIG. 2 illustrates a timing diagram of signals applied the pixel circuit shown in FIG. 1.

FIG. 3 illustrates a circuit diagram of a conventional pixel circuit.

DETAILED DESCRIPTION OF PREFERRED EMBODIMENTS

Figure 1:
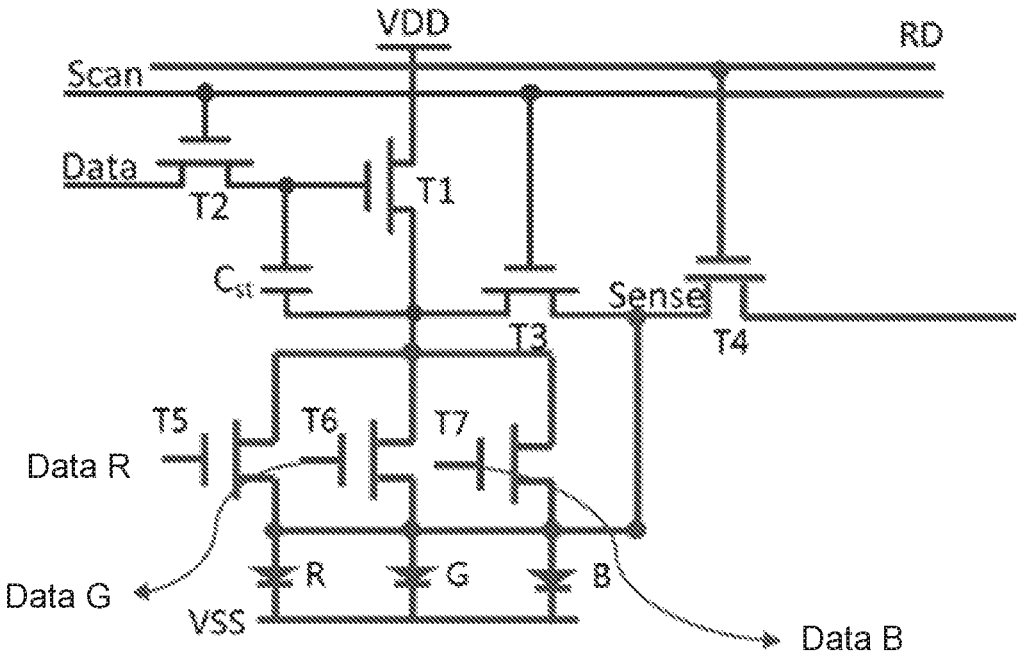
FIG. 1 illustrates a circuit diagram of a pixel circuit according to a preferred embodiment of the present disclosure.

To help a person skilled in the art better understand the solutions of the present disclosure, the following clearly and completely describes the technical solutions in the embodiments of the present invention with reference to the accompanying drawings in the embodiments of the present invention. Apparently, the described embodiments are a part rather than all of the embodiments of the present invention. All other embodiments obtained by a person of ordinary skill in the art based on the embodiments of the present invention without creative efforts shall fall within the protection scope of the present disclosure.

The present disclosure proposes a display panel, preferably an active-matrix organic light emitting diode (AMOLED) panel. The display panel includes a pixel circuit.

As shown in FIG. 1, the pixel circuit according to the preferred embodiment of the present invention includes a first transistor T1, a second transistor T2, a third transistor T3, a fourth transistor T4, a fifth transistor T5, a sixth transistor T6, a seventh transistor T7, a first lighting element R, and a storage capacitor Cst. The first lighting element R includes an anode and a cathode electrically connected to a reference voltage Vss.

The first transistor T1 includes a drain electrically connected to a supply voltage Vdd, a source electrically connected to the second end of the storage capacitor Cst, and a gate coupled to a drain of the second transistor T2. The first transistor T1 supplies constant driving current.

The second transistor T2 includes a drain electrically connected to the first end of the storage capacitor Cst, a source electrically connected to a data line (Data), and a gate electrically connected to a scan line Scan.

The third transistor T3 includes a drain electrically connected to a sensing line Sense, a source electrically connected to the source of the first transistor T1, and a gate electrically connected to the scan line Scan.

The fifth transistor T5 includes a drain electrically connected to the anode of the first lighting element R, a source electrically connected to the source of the first transistor T1, and a gate electrically connected to a first lighting data line (Data R).

The fourth transistor T4 includes a source electrically connected to the sensing line Sense, a drain electrically connected to a resetting line, and a gate electrically connected to a read line.

A second lighting element G has an anode and a cathode electrically connected to the reference voltage Vss. The sixth transistor T6 includes a source electrically connected to the source of the third transistor T3, a drain electrically connected to the anode of the second lighting element, and a gate electrically connected to a second lighting data line (Data G).

A third lighting element B includes an anode and a cathode coupled to the reference voltage Vss. The seventh transistor T7 includes a source electrically connected to the source of the third transistor T3, a drain electrically connected to the anode of the third lighting element B, and a gate electrically connected to a third lighting data line (Data B).

In the present embodiment, the fourth transistor T4 is used to prevent current leakage from the sources of the fifth transistor T5, sixth transistor T6, and a seventh transistor T7 to the sensing line Sense. For instance, when the first lighting element R, second lighting element G, third lighting element B are not operated, the fourth transistor T4 detects the threshold voltages of the fifth transistor T5, sixth transistor T6, and seventh transistor T7. When the first lighting element R, second lighting element G, third lighting element B are operated, the fourth transistor T4 does not detect the threshold voltages of the fifth transistor T5, sixth transistor T6, and seventh transistor T7.

As illustrated in FIG. 2, a method of driving the pixel circuit as disclosed above includes steps:

During a first time period TM1 that a high level voltage signal is inputted to the scan line Scan, the data line (Data), the read signal line, and a low level voltage signal is inputted to the first lighting data line (Data R), the second lighting data line (Data G), and the third lighting data line (Data B), the first transistor T1, the second transistor T2, the third transistor T3, and fourth transistor T4 are conducted, and the storage capacitor Cst are charged. A magnitude of current flowing through the first transistor T1 is adjusted by controlling a charge of the storage capacitor Cst. During a first time period TM1, the sensing line Sense is used to monitor the first transistor T1, the fifth transistor T5, the sixth transistor T6, and the seventh transistor T7 by controlling on and off states of the third transistor T3.

During a second time period TM2 that the high level voltage signal is inputted to the read signal line and the first lighting data line (Data R), and the low level voltage signal is inputted to the scan line Scan, the data line (Data), the second lighting data line (Data G), and the third lighting data line (Data B), the fourth transistor T4 and the fifth transistor T5 are conducted to drive the first lighting element R to light, and a source voltage of the fifth transistor T5 is obtained, the source voltage of the fifth transistor T5 indicates the threshold voltage of the fifth transistor T5.

During a third time period TM3 that the high level voltage signal is inputted to the read signal line and the second lighting data line (Data G), and the low level voltage signal is inputted to the scan line Scan, the data line (Data), the first lighting data line (Data R), and the third lighting data line (Data B), the fourth transistor T4 and the sixth transistor T6 are conducted to drive the second lighting element G to light, and a source voltage of the sixth transistor T6 serving as a threshold voltage of the sixth transistor T6 is obtained.

During a fourth time period TM4 that the high level voltage signal is inputted to the read signal line and the third lighting data line (Data B), and the low level voltage signal is inputted to the scan line Scan, the data line (Data), the first lighting data line (Data R), and the second lighting data line (Data G), the fourth transistor T4 and the seventh transistor T7 are conducted to drive the third lighting element B to light, and a source voltage of the seventh transistor T7 serving as a threshold voltage of the seventh transistor T7 is obtained.

According to the present embodiment, the threshold voltages of the fifth transistor T5, sixth transistor T6, and seventh transistor T7 are used to compensate uneven display image of the display panel.

The method of driving the pixel circuit according to the present disclosure proposes obtaining threshold voltages of transistors by the first lighting data line (Data R), second lighting data line (Data G), third lighting data line (Data B) in response to inputting high level voltage to the scan line Scan, data line (Data), and sensing line Sense, and applying the obtained threshold voltages into corresponding pixels. Because the pixels can select voltages to display based on required brightness, the display panel has good display quality.

As illustrated in FIG. 3, in the related art, one OLED is driven by three thin film transistors and one capacitor. That is, nine thin film transistors and three capacitors, called as 9T3C pixel circuit, are needed to drive red (R), green (G), blue (B) subpixels. By contrast, the pixel circuit of the present invention adopts seven transistors and one capacitor (7T1C) pixel circuit to drive red (R), green (G), blue (B) subpixels, which is less than the conventional 9T3C pixel circuit by two transistors and two capacitors. Accordingly, the present invention provides a pixel circuit, a related driving method and a display panel. The present invention can reduce an occupied area of the pixel circuit, solving the above-mentioned issue relating to requiring processes to make complicated circuit layout in a limited space, and upgrading the display quality of the display panel.

Above are embodiments of the present invention, which does not limit the scope of the present invention. Any modifications, equivalent replacements or improvements within the spirit and principles of the embodiment described above should be covered by the protected scope of the invention.

What is claimed is:

1. A pixel circuit, comprising:

a storage capacitor (Cst), comprising a first end and a second end;

a first lighting element (R) comprising an anode and a cathode electrically connected to a reference voltage (Vss);

a first transistor (T1), comprising a drain electrically connected to a supply voltage (Vdd), a source electrically connected to the second end of the storage capacitor (Cst), and a gate;

a second transistor (T2), comprising a drain electrically connected to the first end of the storage capacitor (Cst), a source electrically connected to a data line (Data), and a gate electrically connected to a scan line (Scan);

a third transistor (T3), comprising a drain electrically connected to a sensing line (Sense), a source electrically connected to the source of the first transistor (T1), and a gate electrically connected to the scan line (Scan); and a fifth transistor (T5), comprising a drain electrically connected to the anode of the first lighting element (R), a source electrically connected to the source of the first transistor (T1), and a gate electrically connected to a first lighting data line (Data R).

2. The pixel circuit of claim 1, further comprising:

a fourth transistor (T4), comprising a source electrically connected to the sensing line (Sense), a drain electrically connected to a resetting line, and a gate electrically connected to a read line.

3. The pixel circuit of claim 2, further comprising:

a second lighting element (G) having an anode and a cathode electrically connected to the reference voltage (Vss); and a sixth transistor (T6), comprising a source electrically connected to the source of the third transistor (T3), a drain electrically connected to the anode of the second lighting element (G), and a gate electrically connected to a second lighting data line (Data G).

4. The pixel circuit of claim 3, further comprising:

a third lighting element (B), comprising an anode and a cathode coupled to the reference voltage (Vss); and a seventh transistor (T7), comprising a source electrically connected to the source of the third transistor (T3), a drain electrically connected to the anode of the third lighting element (B), and a gate electrically connected to a third lighting data line (Data B).

5. The pixel circuit of claim 4, wherein the fourth transistor (T4) is used to prevent current leakage from the sources of the fifth transistor (T5), sixth transistor (T6), and a seventh transistor (T7) to the sensing line (Sense).

6. The pixel circuit of claim 1, wherein the first transistor (T1) supplies constant driving current.

* * * * *